US005975344A

United States Patent [19]

Stevens

[11] Patent Number: 5,975,344

[45] Date of Patent: Nov. 2, 1999

[54] CLOSURE HAVING CONTROLLED RADIAL FLEX

[75] Inventor: Bryan M. Stevens, Shelby Township, Mich.

[73] Assignee: Letica Corporation, Rochester, Mich.

[21] Appl. No.: 09/040,092

[22] Filed: Mar. 17, 1998

[51] Int. Cl.[6] ..... B65D 41/16

[52] U.S. Cl. ..... 220/790; 206/508; 220/780; 220/781; 220/782; 220/789

[58] Field of Search ..... 220/780–783, 220/789, 790, FOR 100, FOR 101; 215/DIG. 1; 206/508

[56] References Cited

U.S. PATENT DOCUMENTS

| | | | |
|---|---|---|---|
| 3,360,156 | 12/1967 | Bohlman | 220/783 |
| 4,288,000 | 9/1981 | Luker et al. | 206/508 X |
| 4,512,493 | 4/1985 | Von Holdt | 206/508 X |
| 4,711,364 | 12/1987 | Letica . | |
| 5,540,349 | 7/1996 | Philips | 215/DIG. 1 X |
| 5,725,122 | 3/1998 | Murphy et al. | 206/508 X |

FOREIGN PATENT DOCUMENTS

| | | | |
|---|---|---|---|
| 1388331 | 3/1975 | United Kingdom | 220/FOR 101 |
| 2131775 | 6/1984 | United Kingdom | 220/FOR 101 |

*Primary Examiner*—Stephen K. Cronin
*Assistant Examiner*—Robin Hylton
*Attorney, Agent, or Firm*—Young & Basile, P.C.

[57] ABSTRACT

An improved deep wiper closure for open head shipping containers wherein the closure exhibits an upwardly opening channel in the closure structure between a wiper wall and a riser wall, the riser wall connecting the wiper wall with a planar central panel of the closure. Angled ribs, each preferably integrally attached to only one of the walls, are disposed in the channel to provide controlled flexure between the walls under extreme side impact conditions.

12 Claims, 2 Drawing Sheets

CLOSURE HAVING CONTROLLED RADIAL FLEX

FIELD OF THE INVENTION

This invention relates to molded plastic closures for open head shipping containers and, more particularly, to a closure including an improved rib configuration which permits controlled radial flexing between radially adjacent portions of the closure structure under conditions of extreme use and/or handling.

BACKGROUND OF THE INVENTION

Plastic closures, typically injection molded from polyethylene, have been used for many years in combination with open head shipping containers. Such closures typically provide a "plug fit" with the container; i.e. the closure structure defines a circular, inverted U-shaped channel which opens downwardly to receive the top edge of the container therein. When applied to a container, the inside wall of the channel lies against the inside surface of the container. See, for example, U.S. Pat. No. 4,711,364 to Ilija Letica.

In closures intended for heavy duty usage, this inside wall, called a "wiper", can extend quite far into the container. In such designs, it is desirable to form another vertical circular wall, herein called a "riser wall", inboard of the wiper so that the center panel of the closure is placed closer to the top of the container wall; this effectively increases the container interior volume. In this case an upwardly opening U-shaped channel is formed between the wiper wall and the riser wall.

In prior art closures, bridge ribs have been formed integrally with and extending radially between the wiper wall and the riser wall to provide very high radial rigidity in the structure of the closure. It has been found, however, that these integral and radial bridge ribs act as stress concentrators in the event of extremely high side loads that are typically created when a container is inadvertently dropped on its side in a filled and sealed condition. Such extreme loads occasionally cause fracturing of the radial bridge ribs and/or the center panel of the closure structure, thereby creating a loss of structural integrity in the closure and possible spoilage or contamination of the contents within the container.

SUMMARY OF THE INVENTION

The purpose of the present invention is to eliminate the stress concentrators of the prior art bridge ribs and to provide controlled flexural capability between the wiper wall and the riser wall of a closure for open head type containers. To achieve this purpose, the rigid, radial bridge ribs are replaced with one or more flex control ribs which permit relative movement between the wiper and riser walls under high load conditions.

In the preferred form of the present invention, the flex control ribs take the form of integral plastic members disposed in an upright U-shaped channel between the wiper wall and the riser wall, but extending only partially between those walls. Such ribs may preferably be arranged in groups, spaced apart near and along the circumference of the closure, with one or more ribs in each group extending in one direction between the two walls while one or more additional ribs extend in the opposite direction between the two walls. Many different arrangements are possible.

In the preferred embodiment, hereinafter described in more detail, the flex control ribs are arranged at an angle to a radius. Such angled ribs provide overall controlled flexibility in an otherwise relatively rigid structure.

The various features and advantages of the present invention will be best understood from a reading of the following specification which therein describes a preferred embodiment of the invention intended for use with heavy duty, stackable plastic shipping containers.

DETAILED DESCRIPTION OF AN ILLUSTRATIVE EMBODIMENT

Figure 1:
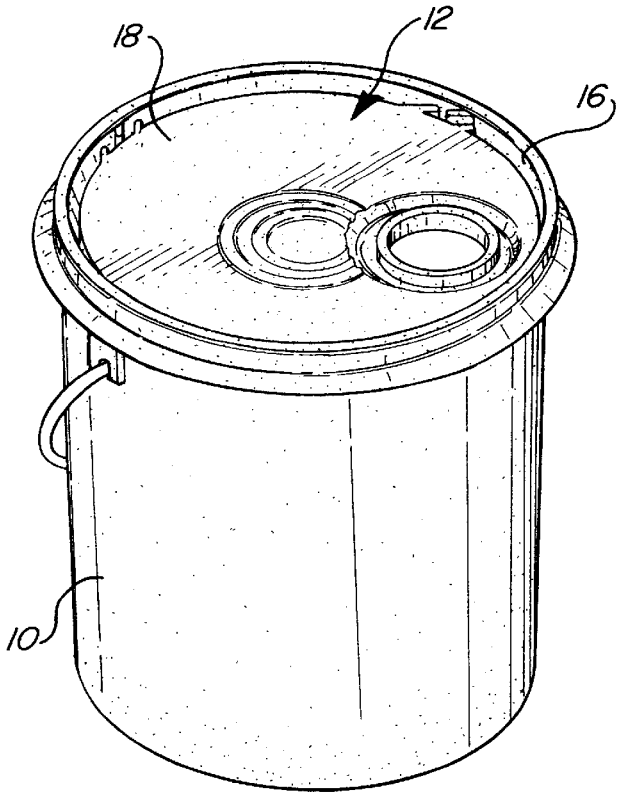
FIG. 1 is a perspective view of an open head shipping container having disposed thereon a molded plastic closure embodying the invention.
Figure 5:
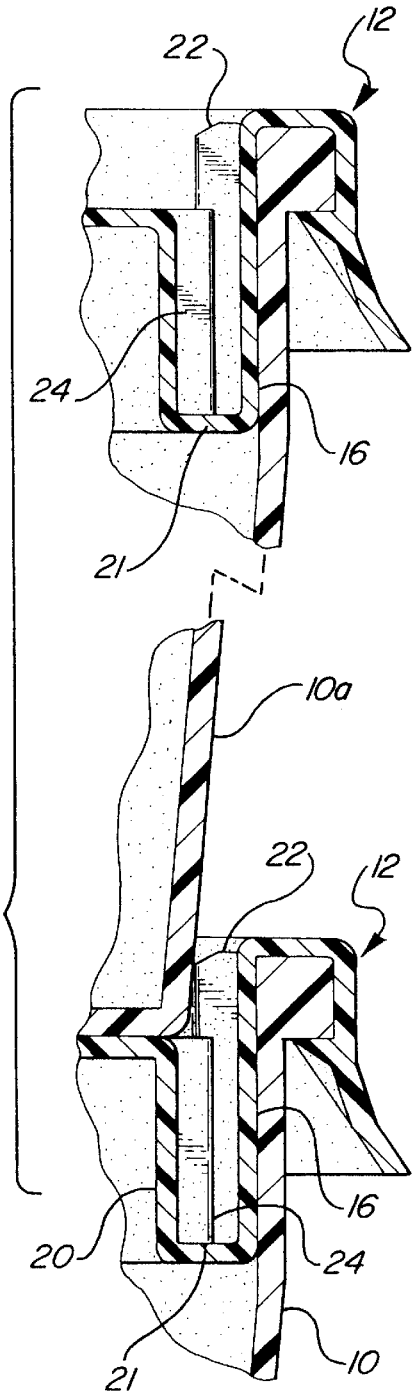
FIG. 5 is a two-part sectional drawing demonstrating how the ribs of the molded plastic closure operate to center and stack a second container.
Figure 3:
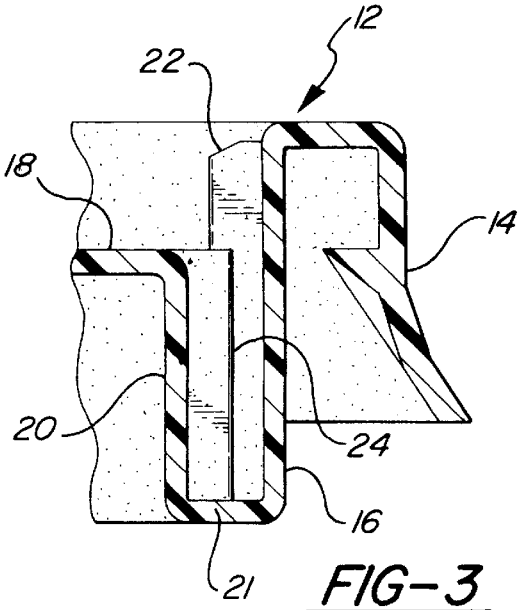
FIG. 3 is a sectional and side view of the closure of FIG. 1.

Looking to FIG. 1, there is shown a generally cylindrical molded polyethylene shipping container 10 of the open head type having a molded polyethylene closure 12 fitted thereon. As shown in FIG. 3, the closure 12 is provided with an inverted U-shaped peripheral channel, defined by an outer wall or skirt 14 and an inner wiper wall 16. As best shown in FIG. 5, the wiper wall 16 extends deeply into the container 10 and lies against the inside surface of the container 10 when the closure 12 is properly applied to the container 10. The container 10 and the closure 12, as thus far described herein, are conventional and interact in a known manner. More particularly, the inverted U-shaped channel of the closure 12 is adapted to receive and lock onto the beaded upper peripheral edge of the container 10 when the closure 12 is properly applied to the container 10.

For a typical 5 or 6 gallon container, the wiper wall 16 is on the order of 1¼" deep. A deep wiper wall of this type is preferred and/or required for many domestic and international shipping applications to provide structural security and integrity in the interconnection between the closure 12 and the container 10.

Figure 2:
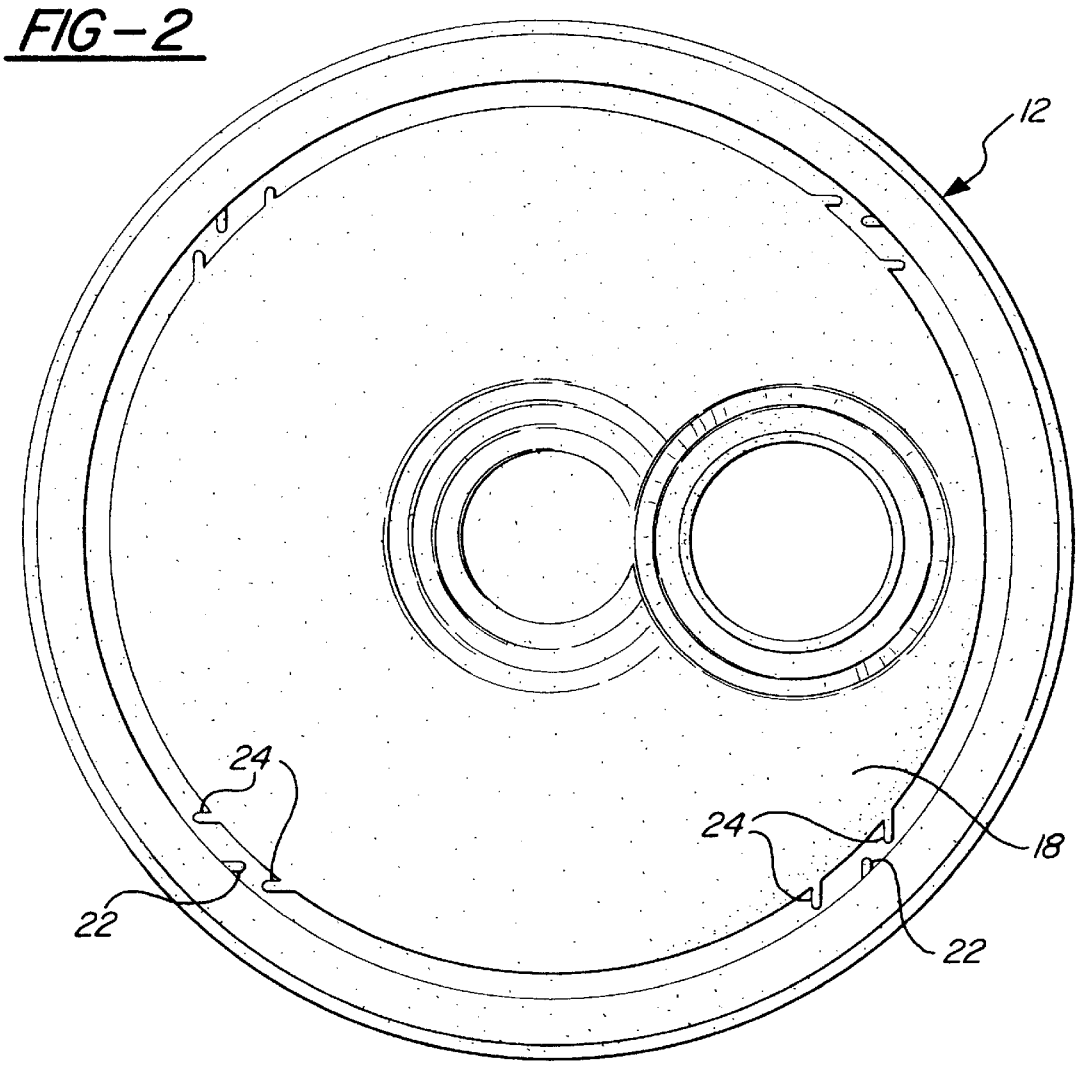
FIG. 2 is a top plan view of the closure of FIG. 1.
Figure 4:
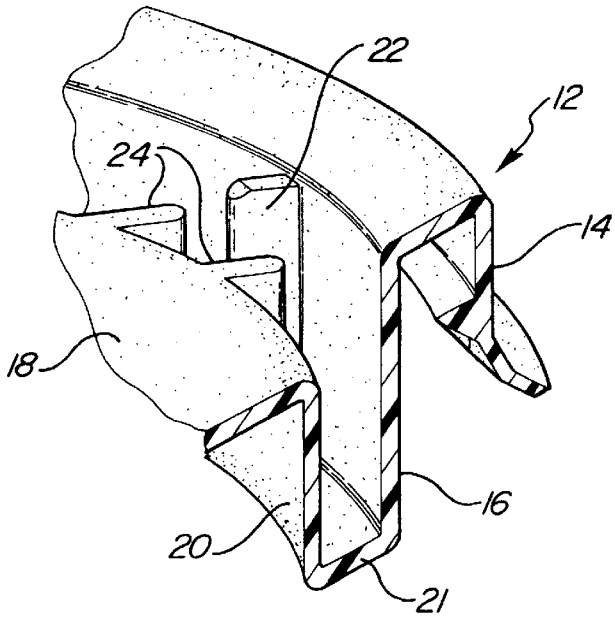
FIG. 4 is a perspective view, partly in section, of the detail of the closure of FIG. 1.

As shown in FIGS. 2 and 4, the closure 12 is provided with a generally planar central panel 18 which, in this particular embodiment, lies approximately ⅝" below the uppermost extremity of the periphery of the closure 12. As shown in FIG. 2, the central panel 18 may be provided with a structure to receive a spout and/or a smaller-sized supplemental or secondary closure. The central panel 18, as shown in FIGS. 3 and 4, is indirectly integrated with the wiper wall 16 by a riser wall 20 which is radially spaced inward from the wiper wall 16 and an annular lower wall 21 extending between and connecting respective lower ends of the wiper wall and riser wall to provide an upright U-shaped groove or channel which is plainly visible when the upper surface of the closure 12 is viewed.

Disclosed in the upright U-shaped channel are upstanding flex control ribs 22 which are integral with the wiper wall 16 and which extend only partially across the channel from the wiper wall 16 toward the riser wall 20. In addition, each rib 22 is positioned non-radially within the channel. As shown in FIG. 2, there are four such flex control ribs 22. As shown in FIG. 3, the ribs 22 extend nearly to the top of the inverted U-shaped channel of the closure 12 and have angled or sloped upper surfaces to enhance stackability as hereinafter explained. The ribs could, however, be made to terminate below the stacking area.

In addition to the flex control ribs 22, the closure 12 is provided with multiple additional flex control ribs 24 which are integral with the riser wall 20 and which extend partially across the groove or channel toward the wiper wall 16, but are spaced away from the wiper wall 16 under normal conditions of operation. Like the ribs 22, the ribs 24 are positioned non-radially with respect to the center of the central panel 18.

In FIG. 2, although only four general groups of only three ribs are shown, it will be understood that the number of groups, the number of ribs in each group, the number of ribs integral with the wiper wall 16, and the number of ribs integral with the riser wall 20 can each be varied considerably according to the particular wishes of the designer.

During normal operation, the ribs 22, and especially the sloped upper surfaces thereof, are instrumental in facilitating the stacking and/or nesting of filled and sealed multiple containers, one on top of the other. As particularly demonstrated in FIG. 5, a second filled container 10A can be securely stacked on top of the closure 12 of the container 10. It will be appreciated by those familiar with these products and/or similar products that the sloped upper surfaces of the ribs 22 help correct any slight misalignments of the containers 10 and 10A to thereby ensure that, when stacked, the container 10A is generally centered upon the closure 12 of the container 10. In this way, the container 10A settles into a balanced and stacked relationship with the interior structure of the closure 12.

Under extreme but not uncommon conditions of operation and/or handling, the filled and sealed container 10 may inadvertently be dropped on its side, thereby imposing extremely high, short-term radial loads on the container 10 and the structure of the closure 12. Such extreme radial loads tend to deform the closure structure in the radial direction. Under such conditions, however, the ribs 22 and the ribs 24 of the present invention uniquely permit controlled flexing of the closure structure. That is, relative radial movement is permitted between the wiper wall 16 and the riser wall 20 until the space between the vertical edges of the ribs 22 and 24 and the adjoining non-integral walls 20 and 16 are taken up. After the initial shock of such a condition, the ribs 22 and 24 begin to exert more and more resilient resistance, thus controlling further relative flexing of the closure walls 20 and 16 in a fashion which spreads load stress and substantially reduces the tendency to fracture the closure.

While the invention has been described in connection with what is presently considered to be the most practical and preferred embodiment, it is to be understood that the invention is not to be limited to the embodiment disclosed herein but, on the contrary, is intended to cover various modifications and equivalent arrangements that are included within the spirit and scope of the claims appended hereto. For example, the ribs may be formed so as to extend fully between the opposite walls of the channel but either be angled or made very thin in the center for increased flexibility. The partially-extending ribs shown in the drawing may be less angled or even radial, as long as substantial radial flexure is permitted. In general, the greater the number of ribs, the thicker the ribs and the more radial the orientation, the greater is the resulting rigidity. All of these factors may be involved in creating the desired flexural compliance in a given design.

What is claimed is:

1. An improved plastic closure for an open head shipping container wherein said closure comprises (a) an inverted U-shaped peripheral channel adapted to receive and connect to an upper rim of said container, said channel being formed in part by a wiper wall which extends into said container and lies against an interior side surface thereof when applied to said container, (b) a central panel, and (c) a riser wall integrally connecting the wiper wall with the central panel and radially spaced from the wiper wall to define an upright U-shaped channel therebetween; the improvement which comprises:

a plurality of ribs disposed in said upright channel for providing controlled flexing between said wiper wall and said riser wall under load conditions, each rib of said plurality being integral with a first of said wiper wall and said riser wall and extending only partially across said upright channel toward a second of said wiper wall and said riser wall.

2. The closure as defined in claim 1 wherein said ribs of said plurality are arranged in circumferentially spaced groups.

3. The closure as defined in claim 2 wherein at least one of said groups comprises at least a first rib integral with the first of said walls and at least a second rib integral with the second of said walls.

4. The closure as defined in claim 1 wherein at least one of said ribs is angled relative to a radius of said closure.

5. The closure as defined in claim 1 wherein said central panel is substantially planar and lies substantially in a plane which is below an uppermost portion of said inverted U-shaped peripheral channel.

6. The closure as defined in claim 5 wherein at least some of said ribs extend above said plane of said central panel and have at least partially sloped upper edges for tending to center a bottom of a stacked second container into a central disposition relative to said closure.

7. A closure for engaging an upper rim of an open container, said closure comprising:

a central panel having a perimeter;

a riser wall integrally connected to said perimeter of said central panel;

an annular lower wall integrally connected to a bottom of said riser wall;

a wiper wall integrally connected to said lower wall opposite said central panel, said riser wall, said lower wall and said wiper wall together defining an upright U-shaped peripheral channel;

a skirt wall integrally connected to said wiper wall opposite said riser wall, said wiper wall and said skirt wall together defining an inverted U-shaped peripheral channel such that said closure is capable of being engagingly seated on said upper rim of said container and said wiper wall extends into said container and rests against the interior surface of said container; and a plurality of ribs disposed in said upright U-shaped peripheral channel for providing controlled flexural compliance between said riser wall and said wiper wall, each rib of said plurality being integrally connected to a first of said wiper wall and said riser wall, said each rib extending only partially across said upright U-shaped peripheral channel.

8. The closure according to claim 7, wherein said plurality of ribs comprises groups of ribs, said groups being spaced apart around a circumference of said closure.

9. The closure according to claim 8, wherein at least one of said groups comprises at least a first rib extending from said riser wall partially to said wiper wall and at least a second rib extending from said wiper wall partially to said riser wall.

10. The closure according to claim 7, wherein at least one of said ribs extends in a non-radial fashion relative to a center of said central panel.

11. The closure according to claim 7, wherein said central panel is substantially planar and lies substantially in a plane which is below an uppermost portion of said inverted U-shaped peripheral channel.

12. The closure according to claim 11, wherein at least some of said ribs extend above said plane of said central panel and have at least partially sloped upper edges for tending to center a bottom of a stacked second container into a central disposition relative to said closure.

* * * * *